US006615016B2

(12) United States Patent
Kimura

(10) Patent No.: US 6,615,016 B2
(45) Date of Patent: Sep. 2, 2003

(54) TRANSFER MEDIUM BEARING MEMBER AND IMAGE FORMING APPARATUS EMPLOYING TRANSFER MEDIUM BEARING MEMBER

(75) Inventor: Yoichi Kimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,843

(22) Filed: Aug. 7, 2001

(65) Prior Publication Data

US 2002/0044800 A1 Apr. 18, 2002

(30) Foreign Application Priority Data

Aug. 8, 2000 (JP) ..... 2000-239984

(51) Int. Cl.[7] ..... G03G 15/16

(52) U.S. Cl. ..... 399/303; 399/312

(58) Field of Search ..... 399/303, 308, 399/312, 313

(56) References Cited

U.S. PATENT DOCUMENTS 5,623,330 A * 4/1997 Ishibashi ..... 399/330
5,761,595 A * 6/1998 Tarnawskyj et al. ..... 399/308

FOREIGN PATENT DOCUMENTS

JP 2-148074 6/1990

* cited by examiner

*Primary Examiner*—Quana M. Grainger
(74) *Attorney, Agent, or Firm*—Fitzpatrick, Cella, Harper & Scinto

(57) ABSTRACT

A transfer material carrying member for carrying a transfer material for receiving an image from an image bearing member, includes a first layer having a thickness Ha and a second layer having a thickness of Hb. A change, Xa, due to an ambient condition, in a length of the first layer measured in a direction perpendicular to a thickness direction of the first layer, and a change, Xb, due to the ambient condition, in a length of the second layer measured in a direction perpendicular to a thickness direction of the second layer, satisfy:

$$|Xl-Xb|<Ha+Hb.$$

24 Claims, 7 Drawing Sheets

$$(\,|\,Xa-Xb\,|\,)<(Ht=Ha+Hb)$$

$(|Xa-Xb|) < (Ht=Ha+Hb)$ $(|Xa-Xb|) < (Ht1=Ha+Hb)$ $(|Xb-Xc|) < (Ht2=Hb+Hc)$

TRANSFER MEDIUM BEARING MEMBER AND IMAGE FORMING APPARATUS EMPLOYING TRANSFER MEDIUM BEARING MEMBER

FIELD OF THE INVENTION AND RELATED ART

The present invention relates to an image forming apparatus, for example, a copying machine, a facsimile machine, a printer, or the like, which forms an image with the use of an electrophotographic method or an electrostatic recording method. It also relates to a transfer medium bearing member employed by such an image forming apparatus.

In an image forming apparatus, for example, an electrophotographic image forming apparatus, the peripheral surface of a cylindrical electro-photographic photoconductive member (photoconductive drum) as an image bearing member is uniformly charged, and an electrostatic latent image is formed on the uniformed charged surface in accordance with image formation data. This electrostatic latent image is visualized with the use of developer; a so-called toner image is formed. Then, the toner image is transferred from the photoconductive drum onto a piece of transfer medium (recording medium), and is fixed to the transfer medium, to obtain a copy or a print.

Some of the image forming apparatuses are color image forming apparatuses capable of forming a full-color image as well as a monochromatic image. These color image forming apparatuses can be divided into two groups according to the manner in which a full-color image is formed. In one group, a color image forming apparatus comprises a plurality of image forming stations, each of which has its own photoconductive drum, and in each of which a toner image, which is different in color from the toner image formed in the other stations, is formed on the photoconductive drum. A plurality of the thus formed toner images different in color are consecutively transferred in layers onto the same recording medium borne on a transfer medium bearing member, to form a full-color image. In the other group, a color image forming apparatus comprises only a single image forming station with a single photoconductive drum. In a full-color image forming operation, a plurality of tone images different in color are formed in succession on the same photoconductive drum after the preceding toner image is transferred onto the recording medium borne on a transfer medium bearing member. In these groups of image forming apparatuses, recording medium is conveyed by a transfer bearing member, for example, an endless belt suspended around a plurality of rollers, a cylinder formed by stretching a sheet of specific material around a cylindrical skeletal frame, or the like.

FIG. 3 shows the general structure of an example of a color image forming apparatus. An image forming apparatus 100 comprises a plurality of image forming stations Py, Pm, Pc, and Pk. In each image forming station, a toner image different in color from the toner image formed in the other stations is formed. The toner image formed in each station is consecutively transferred onto the same recording medium to form a color image.

The image forming apparatus comprises a transfer belt 51 as a transfer medium bearing member, which is an endless belt and is suspended around four rollers: a driving roller 52 and three supporting rollers 53*a*, 53*b*, and 53*c*. Located above the transfer belt 51 in this embodiment are four image forming stations Py, Pm, Pc, and Pk for forming yellow, magenta, cyan, and black images, correspondingly. Since the four image forming stations Py, Pm, Pc, and Pk are the same in structure, the structures of the image forming stations will be described in detail with reference to the image forming station Py for forming a toner image of a first color (yellow). In the drawings, the elements in each image forming station, which are the same in function as those in the other stations, are given the same referential codes, but are differentiated from those in the other stations by addition of subscripts y, m, c, and k, correspondingly to the referential codes Py–Pk for the yellow, magenta, cyan, and black image forming stations.

Referring to FIG. 4, the image forming station Py for the first color has a cylindrical photoconductive member (photoconductive drum) 1*y* as an image bearing member. During an image forming operation, the photoconductive drum 1*y* is rotationally driven in the direction indicated by an arrow mark A by a driving means (unshown), and the peripheral surface of the photoconductive drum 1*y* is uniformly charged by a magnetic brush type charging apparatus as a charging means. Then, the charged photoconductive drum 1*y* is exposed to an image exposure light L representing the yellow component of an original, by an exposing apparatus (LED based scanning apparatus) 3*y*. As a result, an electrostatic latent image in accordance with the inputted image formation data is formed on the peripheral surface of the photoconductive drum 1*y*. Next, the electrostatic latent image on the photoconductive drum 1*y* is developed into a yellow toner image by a developing apparatus 4*y*.

At the same time as the yellow toner image on the photoconductive drum 1*y* reaches a transfer nip between the peripheral surface of the photoconductive drum 1*y* and a transfer belt 51, a recording medium P, for example, a piece of recording paper, which is fed into the image forming apparatus main assembly from a recording medium cassette 80 as a recording medium storage by a sheet feeding roller 81 or the like, is delivered to the transfer nip by a registration roller 82. In the transfer nip, electrical charge, which is opposite in polarity to the toner, is applied to the recording medium P, on the reverse side, that is, the side on which the image is not going to be transferred and is in contact with the transfer belt 51, by a transfer charge blade 54 as a transfer charging device charged with transfer bias. As a result, the toner image on the photoconductive drum 1*y* is transferred onto the transfer medium P, on the top side. A transferring apparatus 5 (belt type transferring apparatus) comprises the transfer belt 51, rollers 52, 53*a*, 53*b*, and 53*c*, and transfer charge blades 54*y*–54*k*.

After the transfer of the yellow toner image onto the recording medium P, the recording medium P is conveyed to the image forming station Pm for a second color (magenta), as the transfer belt 51 moves in the direction indicated by an arrow mark f.

The image forming station Pm for the second color is the same in structure as the image forming station Py for the first color. Thus, the same processes as those carried in the image forming station Py are carried out in the image forming station Pm. That is, a latent image is formed on the photoconductive drum 1*m*, and the magenta developing apparatus 4*m* develops the latent image into a magenta toner image with the use of magenta toner. Then, the magenta toner image is transferred onto the recording medium P, in a manner to be layered on the yellow toner image, by the function of the transfer charge blade 54*m*, in the transfer nip.

Next, a cyan toner image and a black toner image are formed in the image forming stations Pc for a third color and the image forming station Pk for a fourth color, respectively, and are transferred onto the recording medium P by the transfer charge blades 54*c* and 54*k*, in a manner to be layered on the preceding two toner images, in the corresponding image forming stations. Consequently, a color image, or a composite of four layers of toner images different in color, is formed on the recording medium P. At this point, the color image is yet to be fixed.

After the transfer of the four toner images onto the recording medium P, the recording medium P is conveyed to a fixing apparatus 6 which comprises a fixing roller 6*a* containing a heating means, and a driving roller 6*b*. In the fixing apparatus 6, the toner images on the recording medium P are fixed, as a permanent full-color image, to the surface of the recording medium P by the application of heat and pressure by the fixing roller 6*a* and driving roller 6*b*. After the fixation of the toner images, the recording medium P is discharged into an external delivery tray (unshown), or the like, of the image forming apparatus.

After the recording medium P is separated from the transfer belt 51, the transfer belt 51 is removed from the electrical charge on the reverse side, by a combination of a grounded electrically conductive fur brush 11 and a grounded transfer belt driving roller 52. Further, the foreign substances, for example, toner particles (residual toner particles), paper dust, and the like, on the transfer belt 51, are removed by a transfer belt cleaner 12 comprising a urethane rubber blade and the like, to be prepared for the next image formation cycle.

On the portion of each of the photoconductive drums 1*y*–1*k*, which has just passed the transfer nip, residual toner particles, that is, toner particles which failed to be transferred onto the recording medium P, are present, although only by a small amount. These residual toner particles are scraped away, electrostatically and mechanically, and are temporarily absorbed, by the magnetic brush of each of the magnetic brush type charging apparatuses 2*y*–2*k*. As the amount of the transfer residual toner particles in the magnetic brush of each of the magnetic brush type charging apparatuses 2*y*–2*k* increases, the electrical resistance of the magnetic brush itself increases, and eventually, the magnetic brush fails to sufficiently charge the photoconductive drum. As a result, difference in electrical potential is created between the magnetic brush and the peripheral surface of the photoconductive drum, causing the transfer residual toner particles in the magnetic brush to electrostatically transfer onto the photoconductive drum. After transferring onto the photoconductive drum, the transfer residual toner particles are electrostatically taken into the developing apparatus, to be consumed during the following image formation cycles.

In the above-described image forming apparatus 100, the toner images formed in the image forming stations Py, Pm, Pc, and Pk must be precisely aligned, and therefore, the transfer belt 51 as a transfer medium bearing member, which holds and conveys the transfer medium P, must be stable. In the image forming apparatus 100 in this embodiment, the recording medium P is electrostatically held to the transfer belt 51 with the use of electrostatic adhesion rollers 55 and 56. The electrostatic adhesion roller 56 is grounded. As the recording medium P enters an electrostatic adhesion nip in which the electrostatic adhesion rollers 55 and 56 oppose each other with the interposition of the transfer belt 51, a positive bias of 1 kV is applied to the electrostatic adhesion roller 55 to electrostatically adhere the recording medium P to the transfer belt 51.

The above described electrostatic adhesion of the recording medium P, and the toner image transfer in each of the image forming stations Py, Pm, Pc, and Pk, are significantly affected by the electrical properties (electrical resistance, dielectric constant, and the like) and mechanical properties (thickness, mechanical strength, surface properties, and the like) of the transfer belt 51.

First, regarding the electrical properties of the transfer belt 51, for example, electrical resistance, if the electrical resistance of the transfer belt 51 is lower than a certain level, the biases applied to the transfer charge blade 54 and electrostatic adhesion roller 55 interfere with each other through the transfer belt 51, and the electrical charge given to the transfer belt 51 by the transfer charge blade 54 and electrostatic adhesion blade 55 is likely to attenuate. As a result, toner images are disturbed after they are transferred onto the recording medium P, and the electrostatic force for keeping the recording medium P adhered to the transfer belt 51 weakens.

On the other hand, if the electrical resistance of the transfer belt 51 is higher than a certain level, the absolute values of the biases applied to the transfer charge blade 54 and electrostatic adhesion roller 55 must be greater, which is likely to trigger abnormal electrical discharge in the transfer nip and electrostatic adhesion nip, and the abnormal electrical discharge results in an image of inferior quality.

Next, regarding mechanical properties, for example, thickness, if the thickness of the transfer belt 51 is less than a certain level, the transfer belt 51 is insufficient in mechanical strength, being likely to break and/or stretch, and therefore, is not stable, whereas if the thickness of the transfer belt 51 is more than a certain level, the absolute values of the biases applied to the transfer charge blade 54 and electrostatic adhesion roller 55 must be greater than they must be if the electrical resistance of the transfer belt 51 is higher than a certain level, rendering the transfer belt 51 unsatisfactory.

In other words, the transfer belt 51 is sometimes required to satisfy two mutually contradictory requirements, even regarding only one of the aforementioned physical properties. As one of the solutions to this problem, a multilayered transfer belt (51) disclosed in Japanese Laid-open Patent Application 2-148074 is frequently used. This patent application proposes that various functions of the transfer belt (51) be divided among the plurality of functional layers. More specifically, in order to prevent the transfer belt from failing to be satisfactorily removed of the electrical charge thereon, while providing the transfer belt with a sufficient amount of mechanical strength, the transfer belt is multilayered; it is provided with a surface layer, the electrical resistance of which has been adjusted to a sufficiently low level, and a base layer which is mechanically strong.

However, when a transfer belt 51 having a plurality of layers different in function is employed, the transfer belt 51 sometimes warps as shown in FIG. 11, which shows the widthwise cross section of the transfer belt 51 as seen from the direction to which the transfer belt 51 advances. As is evident from the drawing, the belt 51 sometimes warps at both edges.

The studies made by the inventors of the present invention revealed that this phenomenon, or the warping, was caused by the difference in the coefficient of linear expansion among the plurality of functional layers. More specifically, the warping of the transfer belt 51 occurs when the plurality of layers formed of resinous material are different in the ratio at which their measurements fluctuate due to either or both of the ambient temperature and humidity of the transfer belt 51.

If warping such as the above described occurs to the belts or sheets, for example, the transfer belt 51 as a transfer medium bearing member, which are involved in the image forming processes within the image forming apparatus 100, the belts or sheets fail to uniformly contact their counterparts. For example, the transfer belt 51 fails to uniformly contact the photoconductive drum 1 with the interposition of the recording medium P, in the transfer nip, causing the transfer charging means to fail to uniformly charge the transfer belt 51, and further, a gap is created between the recording medium P and transfer belt 51, along the both edges of the recording medium P in terms of the widthwise direction of the transfer belt 51 as shown in FIG. 12. As a result, the toner images are improperly transferred, resulting in a full-color image of inferior quality.

SUMMARY OF THE INVENTION

Thus, the primary object of the present invention is to prevent the transfer medium bearing member employed by an image forming apparatus, from suffering from deformation such as warping caused by the changes in the environmental factors such as temperature or humidity.

Another object of the present invention is to provide an image forming apparatus capable of always producing an excellent image, more specifically, an image which does not suffer from defects which result from unsuccessful image transfer, by preventing the transfer medium bearing member from suffering from deformation such as warping caused by the changes in the environmental factors such as temperature or humidity.

According to an aspect of the present invention for achieving the above objects, a transfer medium bearing member for holding and conveying a transfer medium onto which an image on an image bearing member is to be, or has been, transferred, comprises a minimum of first and second layers laminated to each other, and the amount Xa of the change in the length of the first layer, the amount Xb of the change in the length of the second layer, the thickness Ha of the first layer, and thickness Hb of the second layer, satisfy the following inequity;

$$|Xa-Xb|<Ha+Hb.$$

According to another aspect of the present invention, in an image forming apparatus comprising: an image forming means for forming an image on an image bearing member; a transfer medium bearing member for holding and conveying a transfer medium; and a transferring means for transferring an image on the image bearing member onto the transfer medium being held and conveyed by the transfer bearing member, the transfer medium bearing member comprises a minimum of first and second layers laminated to each other, and the amount Xa of the change in the length of the first layer, the amount Xb of the change in the length of the second layer, the thickness Ha of the first layer, and thickness Hb of the second layer, satisfy the following inequity:

$$|Xa-Xb|<Ha+Hb.$$

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, preferred embodiments of a laminar transfer medium bearing member and an image forming apparatus in accordance with the present invention will be described in detail with reference to the appended drawings.

[Embodiment 1]

First, an embodiment of an image forming apparatus in accordance with the present invention will be described. This embodiment of image forming apparatus is basically the same in structure as a conventional image forming apparatus, except for the structure of the transfer belt as a transfer medium bearing member.

Figure 3:
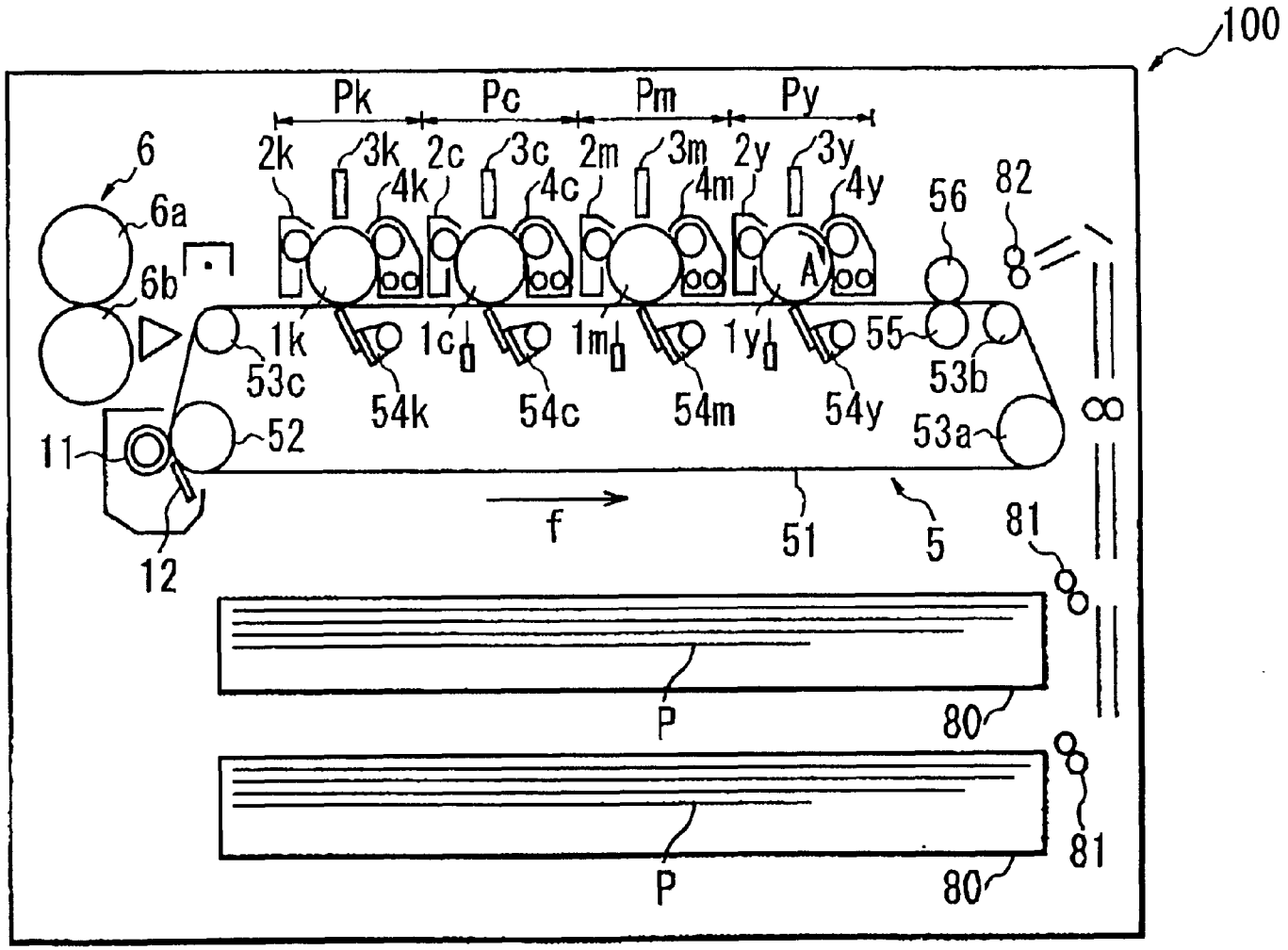
FIG. 3 is a sectional view of an embodiment of an image forming apparatus in accordance with the present invention, for showing the general structure thereof.

FIG. 3 is a sectional view of an example of a color image forming apparatus, for showing the structure thereof. This image forming apparatus comprises a plurality of image forming stations Py, Pm, Pc, and Pk, each of which forms a toner image different in color from the toner image formed in the other stations. The toner images formed in the plurality of image forming stations are consecutively transferred in layers onto the same recording medium to form a multicolor or full-color image.

This embodiment of the image forming apparatus 100 has an endless transfer belt 51 as a transfer medium bearing member, which is suspended by being wrapped around four rollers, which are a driving roller 52 and three supporting rollers 53*a*, 53*b*, and 53*c*. In this embodiment, four image forming stations Py, Pm, Pc, and Pk for forming yellow, magenta, cyan, and black images, correspondingly, are located above the transfer belt 51. Since all the image forming stations are the same in structure, the structures of the image forming stations will be described in detail with reference to the image forming station Py for forming a toner image of a first color (yellow). In the drawings, the elements in each image forming station, which are the same in function as those in the other stations, are given the same referential codes, but are differentiated from those in the other stations by addition of subscripts y, m, c, and k, correspondingly to the referential codes Py–Pk for the yellow, magenta, cyan, and black image forming stations. Incidentally, when differentiation is unnecessary, the subscripts will be omitted.

Figure 4:
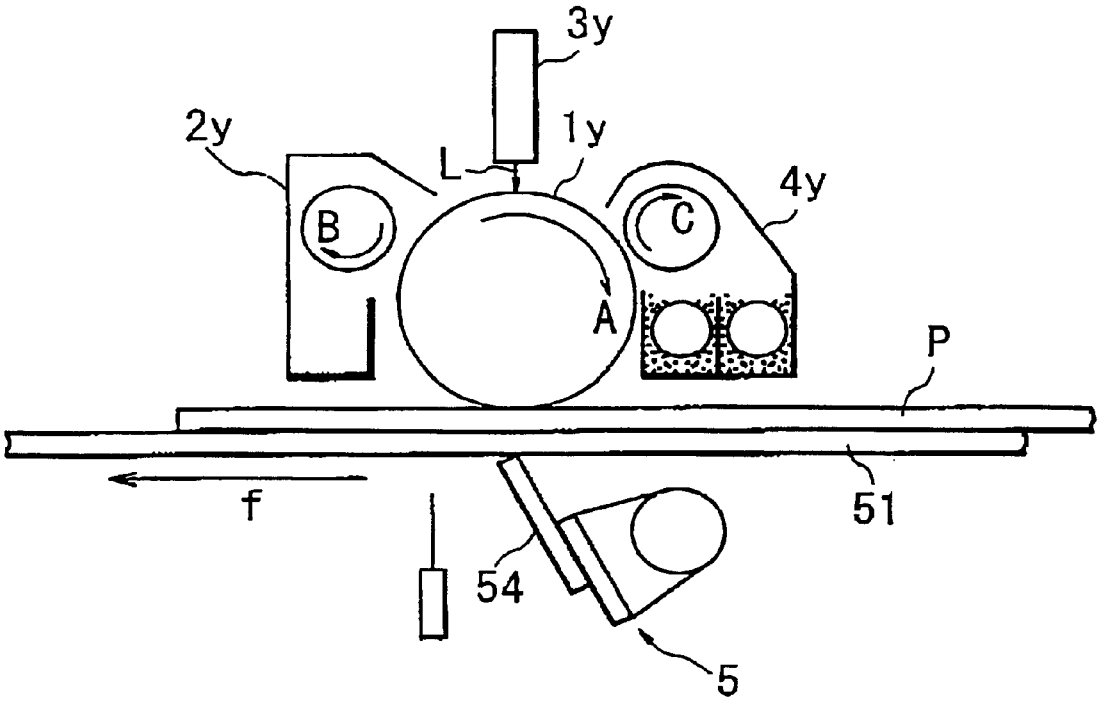
FIG. 4 is an enlarged sectional view of one of the image forming stations in the image forming apparatus in FIG. 3.

Referring to FIG. 4, the image forming station Py for the first color has a cylindrical electrophotographic photoconductive member, that is, a photoconductive drum 1*y*, as an image bearing member, which is located in the approximate center of the station. During an image forming operation, the photoconductive drum 1*y* is rotationally driven about a drum supporting central axle in the direction indicated by an arrow mark A at a predetermined peripheral velocity (process speed). As the photoconductive drum 1*y* is rotated, the peripheral surface of the photoconductive drum 1*y* is uniformly charged by a magnetic brush type charging apparatus 2*y* as a contact charging means. In this embodiment, it is negatively charged. Then, the charged photoconductive drum 1*y* is exposed to an exposure light L projected from an exposing apparatus 3*y* (LED based exposing apparatus) while being modulated with image formation signals. As a result, an electrostatic latent image in accordance with the image formation data is formed on the peripheral surface of the photoconductive drum 1*y*. Next, the electrostatic latent image on the photoconductive drum 1*y* is developed into a toner image by a developing apparatus 4*y*. In this embodiment, the latent image is reversely developed.

Referring to FIG. 3, meanwhile, a plurality of recording media P, for example, sheets of recording paper, stored in a recording medium cassette 80 as a recording medium storage, are fed one-by-one into the image forming apparatus main assembly by a sheet feeding roller 81, and are delivered by a registration roller 82 with a predetermined timing, to the transfer nip in which the peripheral surface of the photoconductive drum 1*y* and the transfer belt 51 of a transferring apparatus 5 oppose each other. In the transfer nip, the yellow toner image on the photoconductive drum 1*y* is transferred onto the recording medium P. The transferring apparatus 5 comprises the transfer belt 51 (transfer medium bearing member), a group of rollers 52, 53*a*, 53*b*, and 53*c*, and transfer charge blades 54 of the image forming stations.

After the transfer of the yellow toner image onto the recording medium P, the recording medium P advances to the image forming station Pm for a second color (magenta) as the transfer belt 51 moves in the direction indicated by an arrow mark f.

The image forming station Pm for the second color is the same in structure as the image forming station Py for the first color. Thus, the same processes as those carried in the image forming station Py are carried out in the image forming station Pm. That is, a latent image is formed on the photoconductive drum 1*m*, and is developed with the use of magenta toner. Then, the magenta toner image is transferred onto the recording medium P, in a manner to be layered on the yellow toner image, by the function of the transfer charge blade 54*m*, in the transfer nip.

Next, a cyan toner image and a black toner image are formed in the image forming stations Pc for a third color and the image forming station Pk for a fourth color, respectively and are transferred onto the recording medium P by the transfer charge blades 54*c* and 54*k*, in a manner to be layered on the preceding two toner images, in the corresponding image forming stations. Consequently, a color image, or a composite of four layers of toner images different in color, is formed on the recording medium P. At this point, the color image is yet to be fixed.

After the transfer of the four toner images onto the recording medium P, the recording medium P is conveyed to a fixing apparatus 6. While the recording medium P is passing through the fixing apparatus 6, the toner particles are melted and fused with the recording medium P by heat and pressure. The fixing apparatus 6 comprises a fixing roller 6*a* containing a heating means, and a driving roller 6*b*. After the fixation of the toner images, the recording medium P is discharged into an external delivery tray (unshown), or the like, of the image forming apparatus, to be accumulated therein.

After the recording medium P is separated from the transfer belt 51, the transfer belt 51 is removed from the electrical charge on the reverse side, by a combination of a grounded electrically conductive fur brush 11 and a grounded transfer belt driving roller 52. Further, the foreign substances, for example, toner particles (residual toner particles), paper dust, and the like, on the top surface of the transfer belt 51, are removed by a transfer belt cleaner 12 comprising a urethane rubber blade and the like, to be prepared for the next image formation cycle.

On the portion of each of the photoconductive drums 1*y*–1*k*, which has just passed the transfer nip, residual toner particles, that is, toner particles which failed to be transferred onto the recording medium P, are present, although only by a small amount. These residual toner particles are scraped away, electrostatically and mechanically, and are temporarily absorbed, by the magnetic brush of each of the magnetic brush type charging apparatuses 2*y*–2*k*. As the amount of the transfer residual toner particles in the magnetic brush of each of the magnetic brush type charging apparatuses 2*y*–2*k* increases, the electrical resistance of the magnetic brush itself increases, and eventually, the magnetic brush fails to sufficiently charge the photoconductive drum. As a result, a difference in electrical potential is created between the magnetic brush and the peripheral surface of the photoconductive drum, causing the transfer residual toner particles in the magnetic brush to electrostatically transfer onto the photoconductive drum. After transferring onto the photoconductive drum, the residual toner particles are electrostatically taken into the developing apparatus, to be consumed during the following image formation cycles.

As for the photoconductive member for this embodiment, it is desired to employ an ordinary organic photoconductive member. Preferably, the organic photoconductive member provided with a surface layer formed of a material with an electrical resistance in a range of $10^9$–$10^{14}$ Ω·cm, or an amorphous silicon based photoconductive member is employed, so that electrical charge can be directly injected to prevent ozone generation and to reduce electric power consumption, as well as to improve the efficiency with which the photoconductive drum is charged.

Figure 5:
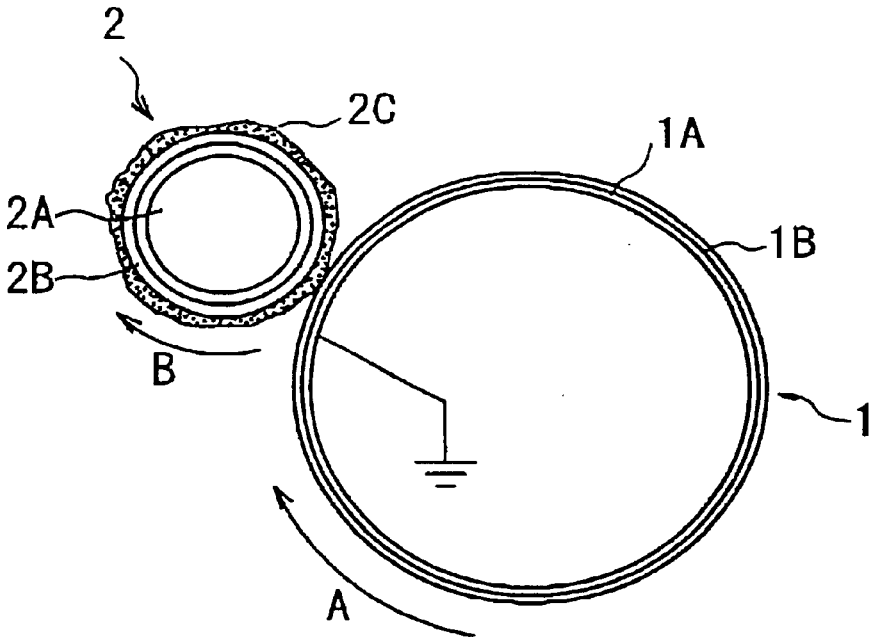
FIG. 5 is an enlarged sectional view of the charging means and its adjacencies in the image forming station in FIG. 4.

Referring to FIG. 5, in this embodiment, the photoconductive drum 1 is a negatively chargeable organic photoconductive member, and comprises a base member 1A, which is an aluminum drum with a diameter of 30 mm, and a photoconductive layer which comprises five sublayers: first to fifth sublayers counting from the innermost layer. It is rotationally driven at a predetermined peripheral velocity (process speed), for example, 120 mm/sec. The innermost sublayer of the photoconductive layer 1B is an undercoat layer, which is an electrically conductive layer with a thickness of 20 μm and is provided to repair the defects of the base drum 1A. The second sublayer is a positive charge transfer prevention layer, which plays a role in preventing the positive charge injected from the base drum 1A from cancelling the negative charge injected into the peripheral surface of the photoconductive drum 1. It is a 1 μm thick layer formed of a mixture of Amiran and methoxyl nylon, and its electrical resistance has been adjusted to approximately $10^6$ Ω·cm, or a medium resistance. The third sublayer is a charge generation layer with a thickness of approximately 0.3 μm, and is a resin layer in which diazo pigments have been dispersed. It generates combinations of positive and negative charges. The fourth sublayer is a charge transfer layer, which is formed of polycarbonate resin in which hydrazone has been dispersed. It is a P-type semiconductor. Therefore, the negative charge given to the peripheral surface of the photoconductive drum I is not allowed to go through this layer, and only the positive charge generated in the third layer (charge generation layer) can be transferred to the peripheral surface of the photoconductive drum 1. The fifth sublayer, or the outermost layer, is a charge injection layer, which is formed by coating a mixture of dielectric resin as binder, and microscopic particles of $SnO_2$, which are electrically conductive particles and has been dispersed in the dielectric binder. More concretely, microscopic particles of $SnO_2$ doped with antimony, that is, electrically conductive transparent filler, to reduce its electrical resistance (to render it electrically conductive) are dispersed in dielectric resin by 70 wt. %, and the thus formulated mixture is coated on the fourth sublayer to a thickness of approximately 3 μm with the use of an appropriate coating method, for example, dipping coating method, spraying coating method, roller coating method, beam coating method, or the like, to form the charge injection layer. The diameter of antimony particle is approximately 0.03 μm.

The charging means employed in this embodiment is a contact charging means which charges the photoconductive drum 1 by contacting the photoconductive drum 1. Referring to FIG. 5, it is a magnetic brush type charging apparatus 2 of a rotational sleeve type, which comprises: a stationary magnetic roller 2A (charge magnetic roller) with a diameter of 16 mm; a nonmagnetic SUS sleeve 2B (charge sleeve) rotationally fitted around the charge magnetic roller 2A; and a magnetic brush layer 2C, that is, a layer of magnetic particles (magnetic carrier) held to the peripheral surface of the charge sleeve 2B by the magnetic force of the charge magnetic roller 2A.

As the magnetic particles for forming the magnetic brush layer 2C, such magnetic particles that are 10–100 μm in average particle diameter, 20–250 $Am^2/kg$ in saturation magnetization, and $1\times10^2$–$1\times10^{10}$ Ω·cm in resistivity are preferable. In consideration of the presence of insulative defects, such as a pin hole, in the photoconductive drum 1, employment of magnetic particles with specific resistivity of no less than $1\times10^6$ Ω·cm is preferable. In order to improve the charging performance of the charging means, the electrical resistance of the magnetic particles is desired to be as small as possible. In this embodiment, magnetic particles which are 25 μm in average particle diameter, 250 $Am^2/kg$ in saturation magnetization, and $5\times10^6$ Ω·cm in resistivity, are employed, and 40 g of such magnetic particles is magnetically adhered to the peripheral surface of the sleeve 2B to form the magnetic brush layer 2C. Incidentally, as for the measurement of the resistance value of the magnetic particles, 2 g of magnetic particles was placed in a metallic cell having a bottom area of 228 $cm^2$, and the resistance value was measured by applying a voltage of 100 V with the presence of a load of 6.6 $kg/cm^2$ upon the magnetic particles in the cell.

The magnetic particles, resinous magnetic particles or single component magnetic particles, for example, magnetite particles, are employed. As for the composition of the magnetic particles, resinous magnetic particles are formed by dispersing magnetic substance and carbon black in resinous substance to make the resinous substance magnetic and electrically conductive, and to adjust the electrical resistance of the resinous substance, whereas single component magnetic particles are coated with resin for electrical resistance adjustment.

The magnetic brush type charging apparatus 2 is disposed so that its magnetic brush layer 2C contacts the peripheral surface of the photoconductive drum 1. In this embodiment, the width of the contact nip n (charge nip) between the magnetic brush layer 2C and photoconductive drum 1 is 6 mm. The charge sleeve 2B is rotationally driven at a peripheral velocity of 150 mm/sec, versus the peripheral velocity of, for example, 100 mm/sec for the photoconductive drum 1, in the direction indicated by an arrow mark B so that the moving direction of the peripheral surface of the charge sleeve 2B in the contact nip n becomes opposite to the moving direction A of the peripheral surface of the photoconductive drum 1 in the contact nip n. While the charge sleeve 2B is rotationally driven as described above, a predetermined charge bias voltage is applied to the charge sleeve 2B from an electrical power source. As a result, the peripheral surface of the photoconductive drum 1 is rubbed by the magnetic brush layer C to which the charge bias is being applied, and the surface of the photoconductive layer 1B of the photoconductive drum 1 is uniformly charged to a predetermined potential level; in other words, the primary charge is injected into the photoconductive drum 1. Increasing the peripheral velocity of the charge sleeve 2B increases the frequency with which the transfer residual toner particles on a given area of the peripheral surface of the photoconductive drum 1 come into contact with the magnetic brush layer 2C, improving therefore the efficiency with which the transfer residual particles are recovered into the magnetic brush layer 2C.

Figure 6:
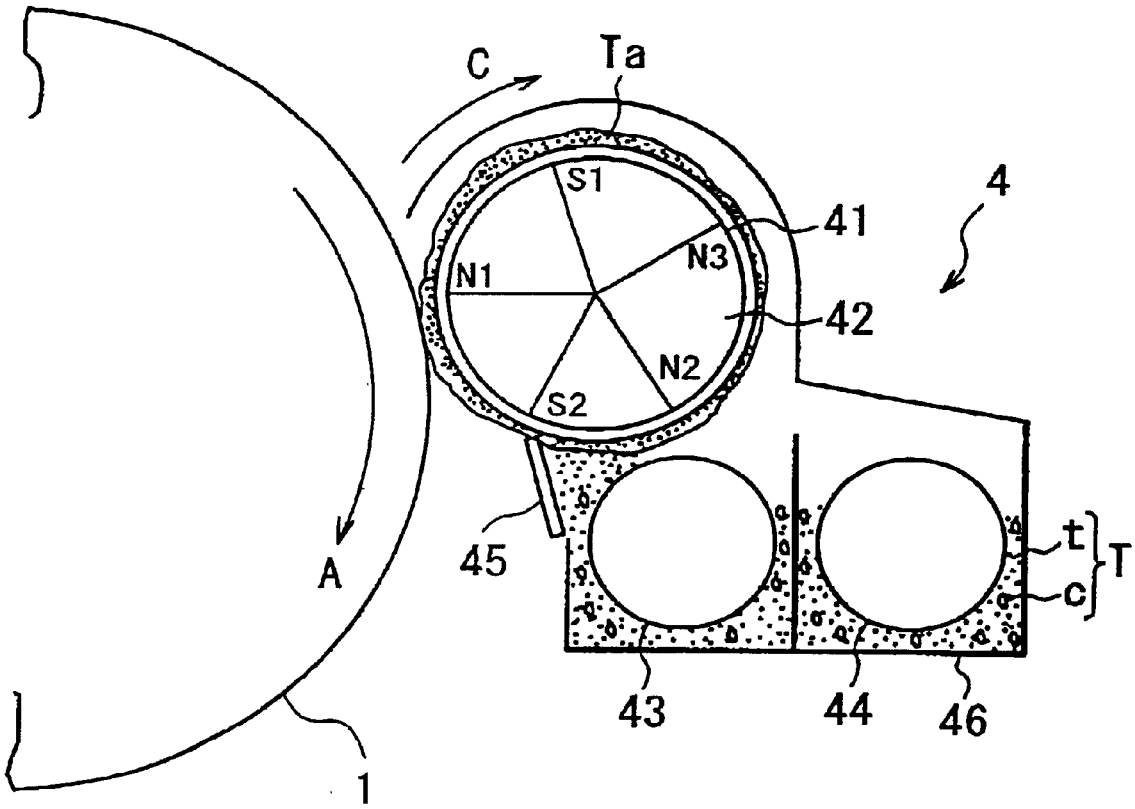
FIG. 6 is an enlarged sectional view of the developing apparatus and its adjacencies in the image forming station in FIG. 4.

FIG. 6 shows the general structure of the developing apparatus 4 with which this embodiment of the image forming apparatus 100 is equipped. In this embodiment, the developing apparatus 4 is a contact type developing apparatus which uses two component developer (two component based magnetic brush type developing apparatus). Referring to FIG. 6, it has a development sleeve 41, which is rotationally driven in the direction of an arrow mark C. Within the hollow of the development sleeve 41, a magnetic roller 42 (development magnetic roller) is stationarily disposed. Within a developer container 46, in which developer T is stored, a couple of stirring screws 43 and 44 are disposed. Further, the developing apparatus 4 is provided with a regulation blade 45, which is positioned so that its edge is placed close to the peripheral surface of the development sleeve 41 to form a thin layer of developer T on the peripheral surface of the development sleeve 41.

The development sleeve 41 is disposed so that the distance between the peripheral surfaces of the development sleeve 41 and photoconductive drum 1 becomes approximately 450 μm at least during development, making it possible for a thin layer 5A of the developer T formed on the peripheral surface of the development sleeve 41 to contact the peripheral surface of the photoconductive drum 1 for development.

The developer T used in this embodiment is a mixture of toner t and magnetic carrier c. The toner t is in the form of a microscopic particle with an average particle diameter of 8 μm produced by pulverization, and externally contains titanium particles with an average particle diameter of 20 nm by 1 wt. %. The carrier c is magnetic carrier, which is 205

$Am^2/kg$ in saturation magnetization and 35 $\mu m$ in average particle diameter. The mixing ratio between the toner t and carrier c in the developer T is 6:94 in weight ratio.

At this time, the development process in which the electrostatic latent image on the peripheral surface of the photoconductive drum 1 is visualized by the developing apparatus 4 which uses a two component magnetic brush based developing method, and the developer T circulating system, will be described. First, as the development sleeve 41 rotates, the developer T is adhered to the development sleeve 41 at the point correspondent to magnetic pole N2 of the development magnetic roller 42, forming a developer T layer. The developer T layer having been adhered to the development sleeve 41 is conveyed to the point correspondent to magnetic pole S2, as the development sleeve 41 further rotates. While the developer T layer on the development sleeve 41 is conveyed to the point correspondent to pole S2, it is regulated in thickness by the regulation blade 45 positioned perpendicular to the development sleeve 41. As a result, a thin layer Ta of the developer T is formed on the peripheral surface of the development sleeve 41. As the thin layer Ta of the developer T borne on the development sleeve 41 is conveyed to the position correspondent to pole N1, the thin layer Ta of the developer T is made to crest, and the electrostatic latent image on the photoconductive drum 1 is developed by this crested portion of the thin layer Ta of the developer T. Thereafter, the developer T on the development sleeve 41 is returned into the developer container 46 by the repulsive magnetic field generated by poles N3 and N2.

To the development sleeve 41, a combination of DC voltage and AC voltage is applied from an electric power source (unshown). In this embodiment, a combination of a DC voltage of −500 V, and an AC voltage having a frequency of 2,000 Hz and a peak-to-peak voltage of 1,500 Vpp, is applied.

Generally, in a two component developing method, application of AC voltage improves development efficiency, producing therefore an image of higher quality. However, it is likely to trigger fog generation. Thus, normally, in order to prevent the fog generation, a certain amount of difference in potential level is provided between the DC voltage applied to the developing apparatus, and the surface potential of the photoconductive drum 1.

Next, the transferring apparatus 5 with which this embodiment of an image forming apparatus is equipped will be described in more detail. Referring to FIG. 3, the transferring apparatus in this embodiment is a belt-type transferring apparatus, which comprises the transfer belt 51 as a transfer medium bearing member, which is an endless belt and is suspended around the driving roller 52 and three supporting rollers 53*a*, 53*b*, and 53*c*, which are follower rollers. The transfer belt 51 is rotationally driven in the direction of the arrow mark f at approximately the same speed as the rotational speed (peripheral velocity) of the photoconductive drum 1. More specifically, the transfer belt 51 is driven so that the moving speed of the peripheral surface of the photoconductive drum 1 and the moving speed of the transfer belt 51 in the direction of the arrow mark f become approximately the same in the transfer nip between the photoconductive drum 1 and the transfer belt 51.

When forming an image using this embodiment of image forming apparatus 100, the toner images formed in the image forming stations Py, Pm, Pc, and Pk, one for one, must be precisely in alignment with each other on the recording medium P, as the recording medium P advances into the image forming stations Py, Pm, Pc, and Pk. In order to precisely align the toner images, the recording medium P must be precisely held to the transfer belt 51 and be stably conveyed. Thus, the recording medium P is electrostatically adhered to the transfer belt 51 with the use of electrostatic adhesion rollers 55 and 56. The adhesion roller 56 is grounded. As the recording medium P enters between the adhesion rollers 55 and 56, a positive bias of 1 kV is applied to the adhesion roller 55 to electrostatically adhere the recording medium P to the transfer belt 51.

The bottom side, in the drawing, of the photoconductive drum 1 of each of the image forming stations Py, Pm, Pc, and Pk is kept in contact with the top surface, in the drawing, of the top side of the loop of the transfer belt 51. The recording medium P is placed on the top surface of the top side of the loop of the transfer belt 51, and is conveyed through the transfer nip of each of the image forming stations Py, Pm, Pc, and Pk. In each transfer nip, a predetermined transfer bias is applied to the transfer blade 54 from an electrical transfer bias application power source (unshown). As a result, the recording medium P is changed to the polarity opposite to that of the toner t from its reverse side. Consequently, the toner image on the photoconductive drum 1 is transferred onto the top surface of the recording medium P.

Figure 1:
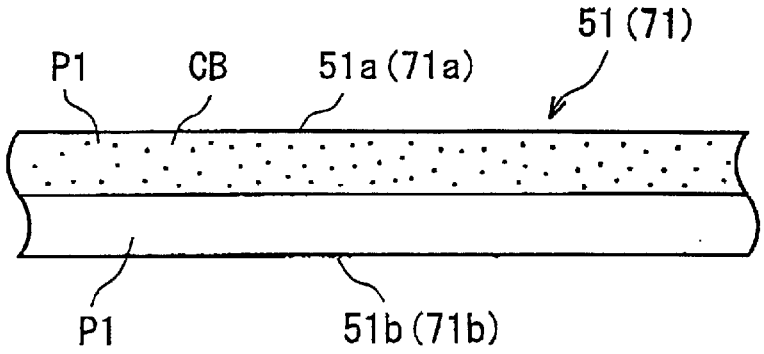
FIG. 1 is a rough sectional view of an embodiment of a transfer medium bearing member in accordance with the present invention.
Figure 2:
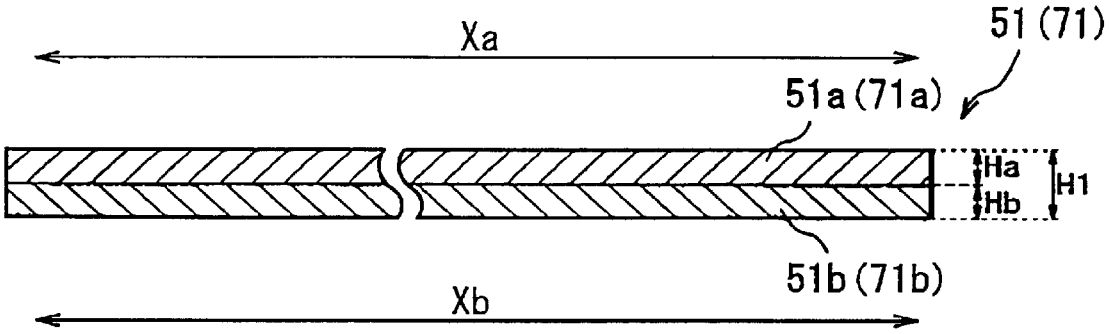
FIG. 2 is a rough sectional view of another embodiment of a transfer medium bearing member in accordance with the present invention.

The transfer belt 51 as a transfer medium bearing member employed in this embodiment is an endless belt formed of laminar material having two layers of thermosetting polyimide resin as shown in FIG. 1.

The width of the transfer belt 51 is 330 mm, which is wide enough for an A3 printing paper, and the circumference of the transfer belt 51 is approximately 1,037 mm The first layer 51*a* (surface layer) of the transfer belt 51, which has the surface (transfer medium bearing surface) which contacts the photoconductive drum 1 is 35 $\mu m$ in thickness, and is formed of thermosetting polyimide resin (PI) in which carbon black (CB) as electrically conductive filler (electrical resistance adjustment agent) has been dispersed to give the transfer belt 51 a surface resistivity (ρs) of $10^{13}$–$10^{14}$ Ω/□. The surface layer 51*a* of the transfer belt 51 in this embodiment contains carbon black as electrical resistance adjustment agent by 10 wt. %.

On the other hand, the second layer 51*b* (back layer) of the transfer belt 51, which has the surface with which the transfer blade 51 contacts, is 40 $\mu m$ in thickness, and is formed of pure thermosetting polyimide resin, that is, such thermosetting resin that does not contain electrical resistance adjustment agent. Thus, the second layer 51*b* is a dielectric layer.

The surface layer (first layer) 51*a* and the back layer (second layer) 51*b* are laminated to each other while polyimide resin is in its precursor state (polyamide resin) to form the laminar transfer belt 51 comprising the integrally laminated surface layer 51*a* and back layer 51*b*. The precursor of the polyimide resin, or polyamide resin, turns into polyimide resins while the transfer belt 51 is molded.

Giving the transfer belt 51 a laminar structure as described above, that is, forming the transfer belt 51 by laminating the surface layer 51*a* adjusted in electrical resistance with the use of electrically conductive filler, and the back layer 52*a* with no adjustment in electrical resistance, to divide the functions of the transfer belt 51 between two layers, makes it possible to provide the transfer belt 51 with appropriate electrical properties as well as mechanical strength for withstanding the repetitions of image forming operations. With the provision of the above-described structural arrangement, it is possible to provide a mechanically strong transfer belt which does not suffer from the above-described problems, such as the interference between the biases applied to the transfer blade 54 and electrostatic adhesion roller 55, the disturbance of the toner images, and the generation of an insufficient amount of recording medium P adhering force, which occur when the electrical resistance of the transfer belt 51 is lower than a certain level, and also, the abnormal electrical discharge in the transfer nips and/or electrostatic adhesion nip, which occurs when the electrical resistance of the transfer belt 51 is higher than a certain level.

The employment of polyimide resin, which is superior in mechanical strength, as the material for the laminar material for the transfer belt 51, drastically reduces the number of times by which the transfer belt 51 needs to be replaced due to the breaking, bending, or the like, of the transfer belt 51, compared to the employment of the thermoplastic resin such as PvdF (polyfluorovinylidene resin) or PC (polycarbonate resin), which has been widely used.

However, it has been known that thermosetting polyimide resin, which is a crystalline resin, has a tendency to relatively easily absorb moisture, and is large in the coefficient of linear expansion resulting from the moisture absorption. The transfer belt 51 in this embodiment employs a laminar structure. Further, it employs thermosetting polyimide resin as the material therefor, and carbon black as electrical resistance adjustment agent has been dispersed in the surface layer 51*a*. Therefore, there is a subtle difference in coefficient of linear expansion, in other words, rate of shrinkage, between the surface layer 51*a* and back layer 51*b*.

Generally, if an object has a laminar structure having two layers different in rate of shrinkage, this object warps toward the layer with the smaller rate of shrinkage, due to the changes in ambience, for example, changes in ambient temperature and/or humidity.

In the case of the endless transfer belt 51 in this embodiment, which is suspended around the plurality of rollers, even if the above described warping occurs, it matters very little as long as the warping concerns the circumferential direction of the transfer belt 51, because the transfer belt 51 is suspended around the driving roller 52 and three follower rollers 53*a*, 53*b*, and 53*c* in a manner to give the transfer belt 51 a constant tension (approximately 3 kgf≈29N) in the circumferential direction of the belt (conveyance direction).

However, if the transfer belt 51 warps in terms of the width direction by a large amount, the recording P, transfer belt 51, and photoconductive drum 1 fail to uniformly contact among themselves in terms of the width direction of the transfer belt 51 as described above. As a result, it becomes impossible for the transfer charging means such as the transfer charge blade 54 to uniformly charge the transfer belt 51 or the recording medium P. Further, there occur air gaps G (FIG. 12) between the transfer belt 51, in particular, its edge portions, and the photoconductive drum 1, and between the transfer belt 51 and the recording medium P, which result in an image of inferior quality (transfer error).

Thus, the inventors of the present invention seriously studied the transfer belt 51 formed of two layers of thermosetting polyimide resin, while paying special attention to the rates of shrinkage of the two layers, and the changes in the measurements of each layer of the transfer belt 51 caused by the changes in ambience (temperature and humidity). In other words, "difference in the measurement change between the two layers", which could be calculated form the shrinkages and lengths of the two layers, and are affected by the ambient factors such as temperature and humidity, were studied. As a result, it was discovered that when the two layers satisfied certain requirements, the above-described problem, or the warping, did not occur.

More specifically, the sizes of the surface and back layers 51*a* and 51*b* of the transfer belt 51 composed of polyimide resin were measured when the ambient temperature and humidity were 15° C. and 10% RH, respectively, that is, when the ambient temperature and humidity are the lowest and the volume of polyimide resin used in this embodiment was smallest, within the normal environment in which the image forming apparatus 100 in this embodiment was used, and also the sizes were measured when the ambient temperature and humidity were 30° C. and 80 %RH, respectively, that is, when the ambient temperature and humidity were the highest and the polyimide resin had swollen to its largest volume, within the normal environment In which the image forming apparatus 100 was used. Then, the difference in the size change between the two layers, the warping of the transfer belt 51, and the image defects caused by the warping, were studied.

Next, the method for measuring the changes in the size of each layer will be described.

First, test pieces were made of each of the resinous materials for the surface layer 51*a* and 51*b*. All test pieces were the same in thickness. Then, the dimensions of the test pieces were measured when the temperature and humidity are highest and lowest within the normal environment (15° C./10% RH –30° C./80% RH) in which an image forming apparatus was used. In other words, they were measured in an environment in which the temperature and humidity were 15° C. and 10% RH, and an environment in which the temperature and humidity were 30° C. and 80% RH. Then, the difference in measurements of corresponding test pieces between the two environments, that is, the expansion, or shrinking, of the test pieces, was obtained.

More concretely, in order to test a laminated transfer belt such as the transfer belt 51 in this embodiment, composed of the surface layer 51*a* which was 1,037 mm in circumference, 330 mm in width, and 35 μm in thickness, and the back layer 51*b* which was 1,037 mm in circumference, 330 mm in width, and 40 μm in thickness, a nonlaminative test piece (i) for the surface layer 51*a* and a nonlaminative test piece (ii) for the back layer 51*b*, were made of resinous materials, which were 330 mm and 330 mm in length, 50 mm and 50 mm in width, and 35 μm and 40 μm in thickness, respectively.

These resinous materials expanded due to the presence of moisture as temperature and humidity increased. In order to compare the surface layer 51*a* and back layer 51*b*, in terms of the absolute value in the widthwise expansion of the transfer belt 51 which caused the widthwise warping of the transfer belt 51, the lengths L (a/low) and L (b/low) of the test pieces for the surface layer (first layer) 51*a* and back layer (second layer) 51*b* in the aforementioned low temperature/low humidity environment, respectively, and the lengths L (a/high) and L (b/high) of the test pieces for the surface and back layers 51*a* and 51*b* in the aforementioned high temperature/high humidity environment, respectively, were measured.

The elongations (measurement change) of the surface and back layers 51*a* and 51*b* were:

elongation (*Xa*) of surface layer=*L* (*a*/high)−*L* (*a*/low) elongation (*Xb*) of back layer=*L* (*b*/high)−*L* (*b*/low).

Thus, the difference in measurement change between the surface and back layers 51*a* and 51*b* was defined as:

difference=|elongation (*Xa*) of surface layer−elongation (*Xb*) of back layer|.

For example, the elongation Xa of the test piece for the surface layer 51*a* of the transfer belt 51, which was formed of thermosetting polyimide resin in which carbon black had been dispersed by 10 wt. %, and the length of which was 330 mm in length, 50 mm in width, and 35 μm in thickness in the environment in which temperature and humidity were 23° C. and 60% RH, was +180 μm. In other words, the length of the surface layer 51*a* in this embodiment in the high temperature/high humidity environment was 180 μm greater than that in the low temperature/low humidity environment.

On the other hand, the elongation Xb of the test piece for the surface layer 51*b* of the transfer belt 51, which was formed of polyimide resin, and the length of which was 330 mm in length, 50 mm in width, and 40 μm in thickness in the environment in which temperature and humidity were 23° C. and 60% RH, was +240 μm. In other words, the length of the surface layer 51*a* in this embodiment in the high temperature/high humidity environment was 240 μm greater than that in the low temperature/low humidity environment.

Incidentally, it had been known that dispersing filler such as carbon black in a certain resinous substance in the same manner as carbon black is dispersed in the resinous material for the surface layer 51*a* of the transfer belt 51 in this embodiment reduces the shrinkage of the resinous substance in proportion to the amount of the filler.

Thus, a plurality of test pieces for the surface layer 51*a*, which were the same in length, that is, 330 mm, but were different in thickness and the amount of the carbon black dispersed in polyimide resin, as shown in Table 1, were made of thermosetting polyimide resin in which carbon black was dispersed, in addition to a test piece for the back layer 51*b*, which was 330 mm in length and 35 μm in thickness, but was made of pure polyimide. Then, the elongations Xa for the test pieces containing carbon black, and the elongation Xb for the test piece containing no carbon black, were measured. As is evident from Table 1, the elongation Xb, that is, the elongation for the test piece for the back layer 51*b*, was 240 μm.

Further, in addition to the above-described test pieces, a plurality of actual laminar transfer belts 51 were made. They had the surface and back layers 51*a* and 51*b*, the specifications of which were as shown in Table 1. These transfer belts were set up in the image forming apparatus 100 in accordance with the present invention, and the images produced by the image forming apparatus 100 in the low temperature/low humidity environment (15° C./10% RH) in which the transfer belts shrank tot he smallest length, and in the high temperature/high humidity (30° C./80% RH) in which the transfer belts swelled to the largest length, were evaluated. When there was a large amount of difference in the measurement change between the surface and back layers 51*a* and 51*b* of the transfer belt 51, and therefore, the recording medium P, transfer belt 51, and photoconductive drum 1 failed to remain in contact with each other, along the edges of the transfer belt 51. As a result, transfer errors occurred, resulting in images of inferior quality, which were low in density across the areas correspondent to the edges of the transfer belt 51. Thus, the images were evaluated with respect to the occurrences of the transfer errors. The results are given in Table 1.

TABLE 1

| Surface layer | Surface layer thickness (μm) | Surface layer elongation (μm) | Difference in dimensional change (μm) | Total thickness (μm) | Image |
|---|---|---|---|---|---|
| Pl | 35 | 240 | 0 | 75 | G |
| Pl + Carbon (10 wt. %) | 35 | 180 | 60 | 75 | G |
| Pl + Carbon (20 wt. %) | 35 | 150 | 90 | 75 | NG |
| Pl + Carbon (30 wt. %) | 35 | 120 | 120 | 75 | NG |
| Pl + Carbon (10 wt. %) | 45 | 180 | 60 | 85 | G |
| Pl + Carbon (20 wt. %) | 45 | 150 | 90 | 85 | F |
| Pl + Carbon (30 wt. %) | 45 | 120 | 120 | 85 | NG |
| Pl + Carbon (10 wt. %) | 55 | 180 | 60 | 95 | G |
| Pl + Carbon (20 wt. %) | 55 | 150 | 90 | 95 | F |
| Pl + Carbon (30 wt. %) | 55 | 120 | 120 | 95 | NG |

G: High quality image with no trace of transfer error.
F: Presence of slight trace of transfer error
NG: Presence of transfer error.

It is evident from the results given in Table 1 that unless the difference in the absolute value of elongation (Xa and Xb) between the surface and back layers 51*a* and 51*b* of the transfer belt 51 exceed the value of the overall thickness 11*t* (thickness Ha of surface layer 51*a*+thickness Hb of back layer 51*b*) of the transfer belt 51, the formation of a low quality image can be almost completely avoided. In other words, satisfying the following inequity (1):

difference in elongation (|elongation of surface layer (*Xa*)−elongation of back layer (*Xb*)|<overall thickness (*Ht*=*Ha*+*Hb*)) (1)

prevents the warping of the transfer belt 51, and therefore, prevents the formation of an image of low quality which results from transfer errors or the like.

In the case of the transfer belt 51 in this embodiment, elongations (Xa) and (Xb) of the surface layer (first layer) 51*a* and back layer (second layer) 51*b* were 180 μm and 240 μm, and therefore, the difference (absolute value) in elongation between the two layers was 60 μm. Thus, difference in elongation (|180 μm−240 μm|<overall thickness (75 μm)).

In other words, the difference in the elongation between the two layers 51*a* and 51*b* was smaller than the overall thickness 76 μm of the transfer belt 51, satisfying the above-described requirement, and therefore, being capable of preventing the problems which result from the warping.

As for the requirement regarding the range of the ambience change, that is, the temperature and humidity ranges, it has only to be assured that the temperature and humidity are kept within ranges of 15–30° C. and 10–80% RH, respectively, in consideration of the actual environment in which an image forming apparatus is used.

Incidentally, this embodiment of the image forming apparatus 100 was described as a color image forming apparatus comprising the plurality of image forming stations Py–Pk.

However, the application of the present invention is not limited to such an image forming apparatus. That is, obviously, the present invention is also applicable to a monochromatic image forming apparatus such as the one shown in FIG. 4, which comprises only a single image forming station, and forms an image on a recording medium P being held to, and conveyed by, a transfer belt 51 as a transfer medium bearing member.

As described above, the present invention can prevent the transfer belt 51 from warping in terms of the width direction. The prevention of the warping of the transfer belt 51 prevents such problems that the transfer belt 51 and/or recording medium P are nonuniformly charged by the transfer charge blade 54 because of the warping of the transfer belt 51, and/or that air gaps are created between the photoconductive drum 1 and recording medium P, along the widthwise edges of the transfer belt 51. The prevention of these problems prevents the formation of a defective image which results from the transfer error caused by these problems. In other words, the present invention can prevent the formation of a defective image which results from the warping of the transfer belt 51.

[Embodiment 2]

Figure 7:
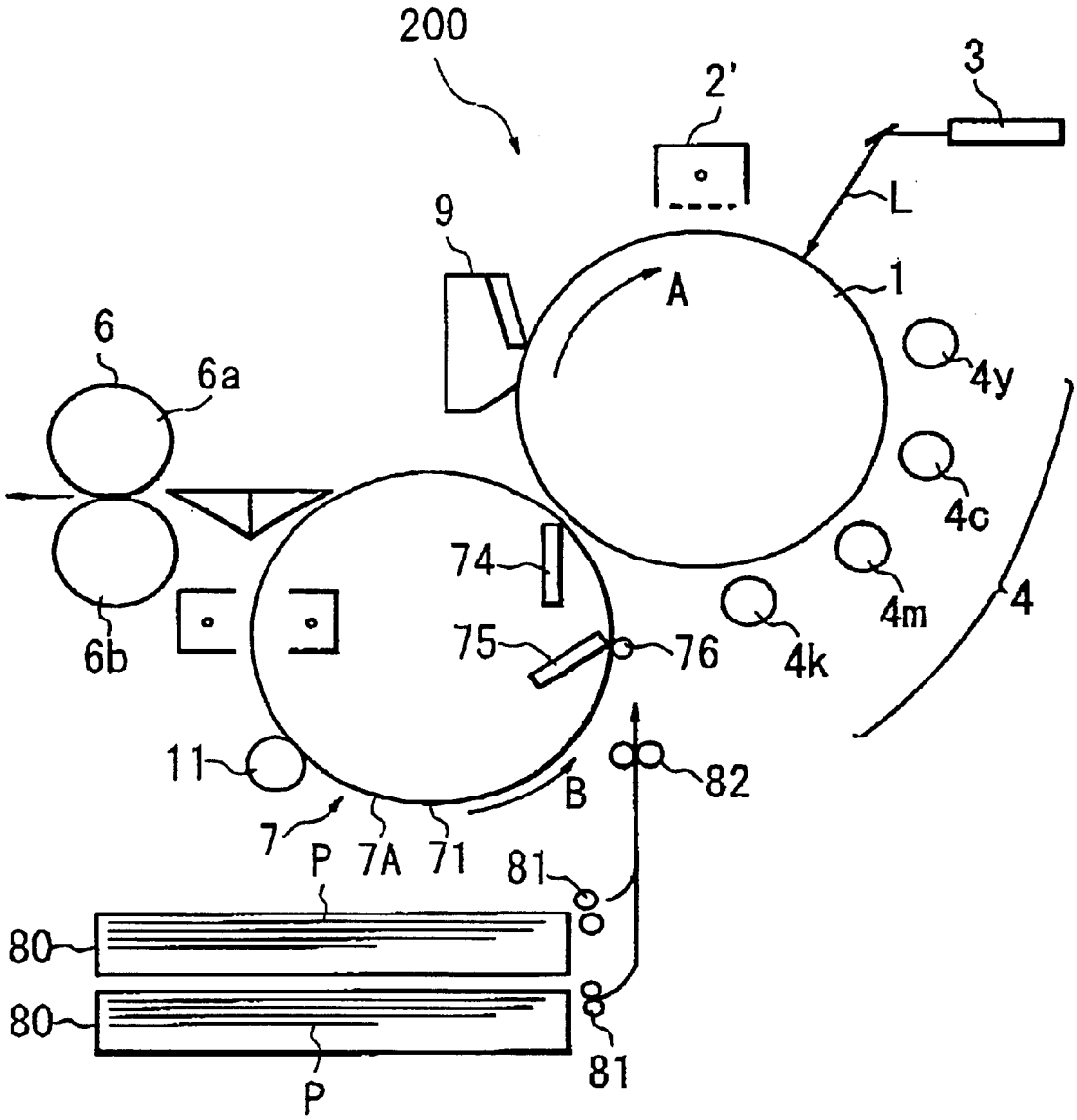
FIG. 7 is a sectional view of another embodiment of an image forming apparatus in accordance with the present invention.

Next, another embodiment of the present invention will be described. FIG. 7 shows the general structure of another embodiment of an image forming apparatus in accordance with the present invention.

The present invention is also applicable to an image forming apparatus such as the image forming apparatus 200 shown in FIG. 7, which is equipped with only one image bearing member on which a plurality of toner images different in color are consecutively formed to be consecutively transferred onto a recording medium P electrostatically adhered to the transfer medium bearing member. The application of the present invention to such an image forming apparatus produces the same beneficial effects as those produced by the first embodiment.

Referring to FIG. 7, the image forming apparatus 200 in accordance with the present invention has only a single image bearing member, which is an electrophotographic photoconductive member in the form of a rotational cylinder, that is, a photoconductive drum 1. It also has a primary charging device 2' as a charging means, an exposing apparatus 3, a developing apparatus group 4, and a cleaner 9, which are disposed around the photoconductive drum 1. The developing apparatus group 4 in this embodiment comprises magenta, cyan, yellow, and black color developing apparatuses 4*m*, 4*c*, 4*y*, and 4*k* for forming magenta, cyan, yellow, and black toner images, correspondingly.

Located diagonally below the photoconductive drum 1 in the drawing is a transferring apparatus 7A (drum type transferring apparatus) as a transfer medium bearing member, which comprises a sheet 71 (transfer sheet) stretched around a cylindrical skeletal frame.

Within the hollow of this transfer drum 7A, an adhesion charge blade 75, and a transfer charge blade 74 as a transfer charging device, are disposed. On the outward side of the transfer drum 7A, an adhesion blade 76 is disposed in a manner to oppose the adhesion charge blade 75 across the transfer sheet 71. The adhesion blade 76 is grounded, and is enabled to be placed in contact with, or separated from, the transfer drum 7A.

As an image forming operation begins, the peripheral surface of the photoconductive drum 1 is uniformly charged by the primary charging device 2,' and is exposed to a laser beam L projected from the exposing apparatus 3, a laser based exposing apparatus, while being modulated with a first color (yellow) component of a target image. As a result, an electrostatic latent image correspondent to the yellow color component of the target image is formed. This electrostatic latent image is visualized into a yellow toner image by the yellow developing apparatus 4*y*.

Meanwhile, a recording medium P such as a piece of recording paper is fed into the image forming apparatus main assembly from a recording medium cassette 80 as a recording medium storage located in the bottom portion of the apparatus main assembly by a pair of sheet feeder rollers 81 and the like, and is delivered to the transfer drum 7A by a registration roller 81 in synchronism with the formation of the yellow toner image on the photoconductive drum 1. The recording medium P is electrostatically adhered to the recording medium bearing portion, that is, the transfer sheet 71, of the transfer drum 7A, by the function of the adhesion charge blade 75 to which voltage is being applied, and the function of the adhesion roller 76 which has been temporarily placed in contact with the transfer drum 7A to adhere the recording medium P to the transfer drum 7A. After the adhesion of the recording medium P to the transfer drum 7A, the adhesion roller 76 is separated from the transfer drum 7A.

The recording medium P borne on the transfer drum 7A is conveyed to a transfer nip, or the interface between the photoconductive drum 1 and transfer drum 7A, by the rotation of the transfer drum 7A in the direction of an arrow mark B in FIG. 7. In the transfer nip, the yellow toner image on the photoconductive drum 1 is electrostatically transferred onto the recording medium P by the function of the transfer charge blade 74 to which voltage is being applied.

Processes similar to the above-described processes carried out for the yellow color component of the target image are consecutively carried out for the cyan, magenta, and black color components so that the consecutively formed toner images are transferred one after another onto the recording medium P borne on the transfer drum 7A which is rotating in the direction of the arrow mark B. Consequently, a full-color image disposed of four unfixed color toner images, is formed on the recording medium P.

Thereafter, the recording medium P is separated from the transfer drum 7A, and is conveyed to a fixing apparatus 6, which comprises a fixing roller 6*a* equipped with a heating means, and a driving roller 6*b*. As the recording medium P is conveyed through the fixing apparatus 6 by the combination of the fixing roller 6*a* and driving roller 6*b*, being pinched between the two rollers, the unfixed toner images on the recording medium P are fixed to the recording medium P by heat and pressure; in other words, they are turned into a permanent full-color image. After the fixation of the toner images, the recording medium P is discharged from the apparatus main assembly.

The transfer residual toner particles, that is, the toner particles remaining on the peripheral surface of the photoconductive drum 1 after the transfer of the toner images, are removed by the cleaner 9 equipped with cleaning means such as a fur brush or an elastic blade. The foreign substances such as toner particles adhering to the transfer sheet 71 of the transfer drum 7A are removed by the transfer drum cleaner 11 equipped with cleaning means such as a fur brush or an elastic blade.

Figure 8:
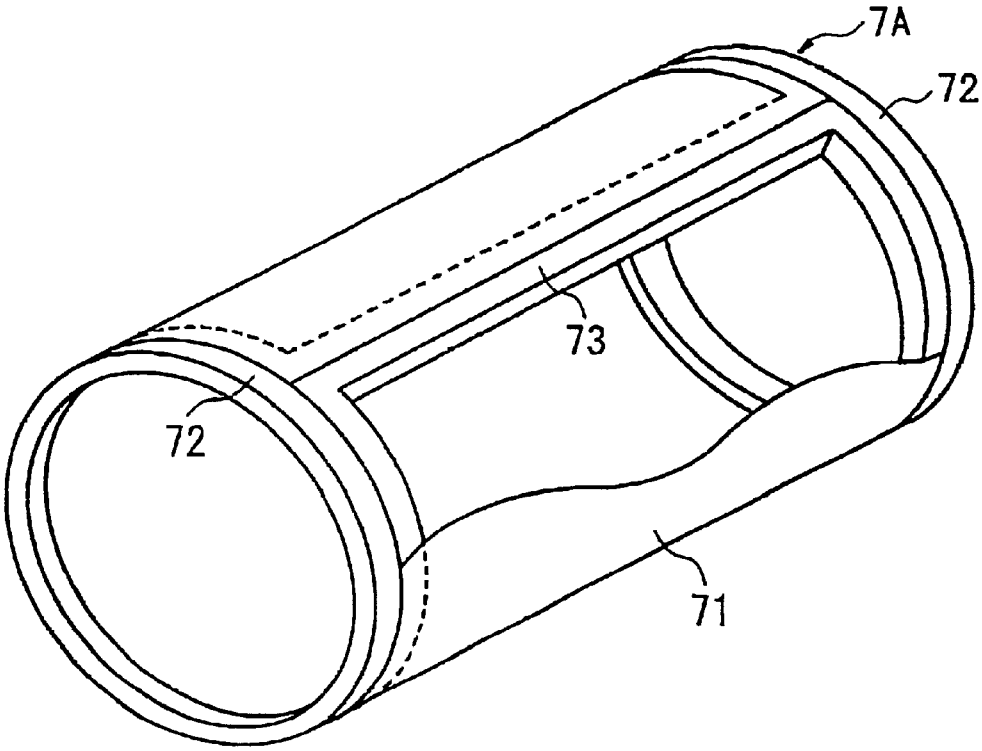
FIG. 8 is a perspective view of a transfer drum in accordance with the present invention.
Figure 9:
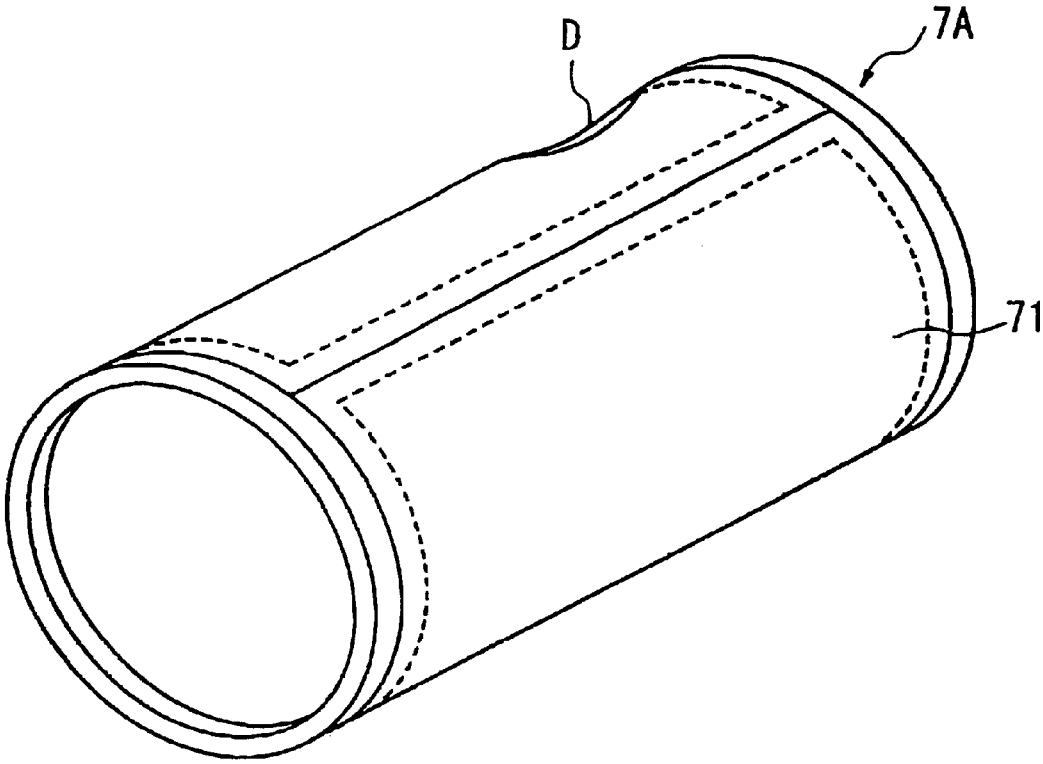
FIG. 9 is a perspective view of a transfer drum, a portion of the peripheral surface of which has been slightly dented.

Next, referring to FIGS. 8 and 9, the transfer drum 7A will be further described.

Referring to FIG. 8, the transfer drum 7A comprises two circular subframes 72, or base rings 72, a straight subframe 73, or a base rod 73, and the transfer sheet 71. The two base rings 72 are connected by the base rod 73, forming the cylindrical skeletal frame of the transfer drum 7A. The transfer sheet 71 is stretched between the two base rings 72 in a manner to wrap the cylindrical skeletal frame in the circumferential direction of the base rings 72, and pasted to the frame.

As the material for the transfer sheet 71 employed by the transfer drum 7A in this embodiment, the same material as that employed in the first embodiment, that is, two layer laminate of thermosetting polyimide resin, is used. After the pasting of the transfer sheet 71 to the frame, the transfer sheet 71 is 330 mm in terms of the width direction of the transfer drum 7A, and 565 mm (transfer drum 7A diameter 180 mmη) in terms of the circumferential direction (transfer medium conveyance direction) of the transfer drum 7A, in the normal environment in which the apparatus is used.

Also in this embodiment, the first layer (surface layer) 71*a*, the surface of which the transfer charge blade 74 contacts, is formed of thermosetting polyimide, and the surface electrical resistance of which has been adjusted to $10^{13}$–$10^{14}$ Ω·cm by dispersing carbon black as electrically conductive filler in the resin. Its thickness is 35 μm. The surface layer 51*a* of the transfer sheet 71 in this embodiment contains carbon black, that is, electrical resistance adjustment agent, by 10 wt. %.

On the other hand, the second layer (back layer) 71*b*, the surface of which the adhesion charge blade 75 and transfer charge blade 74 contact, is formed of pure thermosetting polyimide resin, in other words, polyimide resin which does not contain electrical resistance adjustment agent and therefore, is dielectric. Its thickness is 40 μm. The two layers of polyimide resin are laminated to each other while polyimide resin is in the precursor state (polyamide resin) to form the laminar transfer sheet 71, as done when the transfer belt 51 in the first embodiment is formed. The polyamide resin, or the precursor of the polyimide resin, turns into polyimide resin while the two layers of precursor are molded into the laminar transfer sheet 71.

The transfer drum 7A in this embodiment comprises a cylindrical skeletal frame, and a rectangular transfer sheet 71 slightly loosely wrapped around this cylindrical skeletal frame. The cylindrical skeletal frame comprises two subframes 72 in the form of a ring, and a straight subframe 73 which connects the two rings 72. The four edges of the rectangular transfer sheet 71, that is, the portions of the transfer sheet 71, which correspond in position to the two subframes 72 in the form of a ring, and the straight subframe 73, are adhered to the corresponding portions of the cylindrical skeletal frame, with the use of double-side adhesive tape or the like.

Therefore, the transfer sheet 71 in this embodiment is different from the transfer belt 51 in the first embodiment in that the four edges of the transfer sheet 71 are fixed. In the case of a transfer sheet such as the transfer sheet 71, if warping occurs to the transfer sheet 71 itself, the transfer sheet 71, which normally remains cylindrical by being wrapped around the cylindrical skeletal frame, deforms and loses its cylindrical configuration. More concretely, deformations such as a dent D occur to the transfer sheet 71.

The occurrence of such deformations creates problems similar to those which result from the warping of the transfer belt 51 in the first embodiment. In other words, the deformation of the transfer sheet 71 prevents the transfer sheet 71, recording medium P, and photoconductive drum 1 from contacting each other uniformly across their surfaces, causing therefore transfer errors, which results in the formation of an image of inferior quality. Further, the deformation of the transfer sheet 71 may cause the recording medium P to be improperly adhered to the transfer sheet 71. In other words, the deformation of the transfer sheet may have worse effects than the warping of the transfer belt 51.

However, the transfer sheet 71 in this embodiment is given a laminar structure, being composed of a surface layer 71*a* formed of thermosetting polyimide resin in which carbon black has been dispersed by 10 wt. %, and a back layer 71*b* formed of polyimide resin, and satisfies the following inequity (1) which was presented before, within the normal environment in which the apparatus is operated, that is, within a temperature/humidity range of 15° C./10% RH –30° C./80% RH:

$$\text{difference in elongation } (|\text{elongation of surface layer } (Xa) - \text{elongation of back layer } (Xb)| < \text{overall thickness } (Ht = Ha + Hb)) \quad (1)$$

More specifically, when the ambient temperature and humidity was 23° C. and 60% RH, the surface and bottom layer 71*a* and 71*b* are 330 mm and 330 mm in length, and 35 μm and 45 μm, respectively, as they were measured with the use of the method described regarding the first embodiment. The length changes (elongations) Xa and Xb of the two layers 71*a* and 71*b* between when the ambient temperature and humidity were 15° C. and 10% RH, that is, when two layers 71*a* and 71*b* were shortest within the above described normal operational environment, and when the ambient temperature and humidity were 30° C. and 80% RH, that is, when the two layers 71*a* and 71*b* were longest, were 180 μm and 240 μm, respectively, satisfying the above inequity (1).

The employment of a laminar transfer sheet such as the transfer sheet 71 formed of two layers of thermosetting polyimide can prevent the transfer errors which result as the transfer sheet 71, recording medium P, and photoconductive drum 1 fail to contact each other uniformly across their surfaces, and also prevent such anomalies as the improper adhesion of the recording medium P to the transfer sheet 71 that affects the formation and conveyance of an image. Therefore, the employment of a laminar transfer sheet such as the transfer sheet 71 makes it possible to form an excellent image.

As is evident from the above description of the second embodiment, the present invention is also applicable, with excellent results, to an image forming apparatus, the transfer medium bearing member of which is in the form of a sheet pasted to the cylindrical skeletal frame of the transfer drum.

Also as is evident from the above descriptions, thermosetting polyimide resin, which is a crystalline resin, is superior to thermoplastic resin, in mechanical strength; in other words, the former is more difficult to break than the latter. Therefore, it is preferable as the resinous material for the transfer belt 51 or transfer sheet 71. Since crystalline resin frequently used as the material for the transfer belt 51 or transfer sheet 71 has a relatively large coefficient of linear expansion, the beneficial effects of the present invention are greater. Principally, however, the application of the present invention is not limited to an image forming apparatus, the transfer medium bearing member of which is in the form of a belt or sheet and is formed of thermosetting crystalline resin. Obviously, the application of the present invention is not limited to the preceding embodiments of an image forming apparatus, the transfer medium bearing member of which was formed of polyimide resin. In other words, the present invention is also compatible with laminar material composed of plastic such as polycarbonate resin, polyethylene-terephthalate resin, polyfluorovinylidene resin, polyethylene-naphthalate resin, polyether-ether-ketone resin, polyether-sulfone resin, polyurethane, or the like, and a laminar transfer belt or transfer sheet, as a transfer medium bearing member, formed of such laminar material, in addition to the above described materials and transfer medium bearing members.

As for the overall thickness of the transfer belt 1, it is not limited to 75 μm. It may be in a range of 25–2,000 μm, preferably in a range of 50–150 μm.

In the above description of the embodiments of the present invention, the transfer belt 51 and transfer sheet 71 were described as a laminar member having two layers: first and second layers. The present invention, however, does not need to be limited to the configuration of these transferring members. In other words, the present invention is also compatible with a laminar transfer medium bearing member having three or more layers. When a laminar transfer medium bearing member has three or more layers, assuring that adjacent two layers satisfy inequity (1) presented above suffices. In such a case, the overall thickness Ht in inequity (1) is the sum of the thicknesses of the adjacent two layers.

Figure 10:
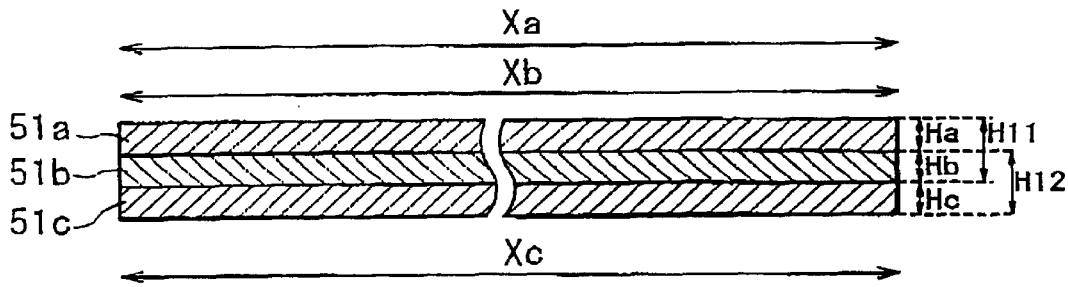
FIG. 10 is a rough sectional view of another embodiment of a transfer medium bearing member in accordance with the present invention.
Figure 11:
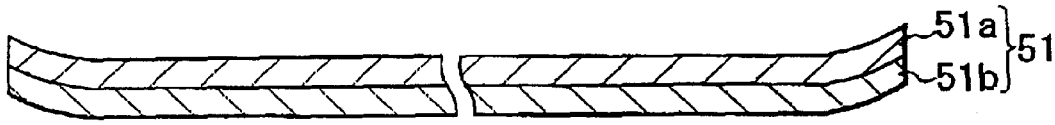
FIG. 11 is a widthwise sectional view of a transfer belt, which has warped.

Referring to FIG. 10, when a laminar transfer medium bearing member has, for example, three layers, that is, first, second, and third layers 51*a*, 51*b*, and 51*c*, with thicknesses of Ha, Hb, and Hc, correspondingly, the elongations Xa, Xb, and Xc of the layers 51*a*, 51*b*, and 51*c*, correspondingly, caused by the changes in the ambience, sum Ht1 of the thicknesses of the first and second layers 51*a* and 51*b*, and sum Ht2 of the second and third layers 51*b* and 51*c*, must satisfy the following inequities:

different in measurement change ($|Xa-Xb|$<thickness ($Ht1=Ha+Hb$) (2)

different in measurement change ($|Xb-Xc|$<thickness ($Ht2=Hb+Hc$) (3)

By configuring the laminar member in manner to satisfy both inequities (2) and (3), the deformation, such as warping, of the laminar member employed by an image forming apparatus, which is caused by the ambient changes, can be prevented, and therefore, an excellent image, that is, an image which does not suffer from defects which result from transfer errors, can be always formed.

As described above, the present invention makes it possible to provide a transfer medium bearing member which does not suffer from such deformation as warping that is caused by the changes in environmental factors such as temperature and humidity. Further, an image forming apparatus employing a transfer medium bearing member in accordance with the present invention can always form an excellent image, that is, an image which does not suffer from defects which result from transfer errors or the like.

While the invention has been described with reference to the structures disclosed herein, it is not confined to the details set forth, and this application is intended to cover such modifications or changes as may come within the purposes of the improvements or the scope of the following claims.

What is claimed is:

1. A transfer material carrying member for carrying a transfer material for receiving an image from an image bearing member, said transfer material carrying member comprising:

a first layer having a thickness Ha; and a second layer adjacent to said first layer, said second layer having a thickness of Hb, wherein a change, Xa, due to a change in an ambient condition, in a length of said first layer measured in a direction perpendicular to a thickness direction of said first layer, and a change, Xb, due to a change in the ambient condition, in a length of said second layer measured in a direction perpendicular to a thickness direction of said second layer, satisfy:

$$|Xa-Xb|<Ha+Hb.$$

2. A transfer material carrying member according to claim 1, wherein the perpendicular directions are perpendicular to a transfer material feeding direction of said transfer material carrying member.

3. A transfer material carrying member according to claim 1, wherein said first layer is contactable to the image bearing member or to the transfer material, and said second layer is disposed across said first layer from the image bearing member or the transfer material.

4. A transfer material carrying member according to claim 1, wherein said first layer and said second layer are made of thermoplastic resin material.

5. A transfer material carrying member according to claim 4, wherein said thermoplastic resin material is polyimide resin material.

6. A transfer material carrying member according to claim 3, wherein said first layer comprises resistance adjusting material.

7. A transfer material carrying member according to claim 6, wherein said resistance adjusting material is carbon black.

8. A transfer material carrying member according to claim 6, wherein said first layer has a surface resistance of $10^{13}$–$10^{14}$ Ohm/□.

9. A transfer material carrying member according to claim 1, wherein said first layer and said second layer are integrally formed.

10. A transfer material carrying member according to claim 1, wherein Ha+Hb is 25–2000 microns.

11. A transfer material carrying member according to claim 1, wherein the ambient condition is at least one of ambient temperature and humidity.

12. A transfer material carrying member according to claim 11, wherein the change in the ambient condition is between 15° C. and 10% RH and 30° C. and 80% RH.

13. An image forming apparatus comprising:

image forming means for forming an image on an image bearing member; and a transfer material carrying member for carrying a transfer material transfer means for transferring an image from the image bearing member onto the transfer material carried on said transfer material carrying member, said transfer carrying member including:

a first layer having a thickness Ha; and a second layer adjacent to said first layer, said second layer having a thickness of Hb, wherein a change, Xa, due to a change in an ambient condition, in a length of said first layer measured in a direction perpendicular to a thickness direction thereof, and a change, Xb, due to a change in the ambient condition, in a length of said second layer measured in a direction perpendicular to a thickness direction thereof, satisfy:

$$|Xa-Xb|<Ha+Hb.$$

14. An image forming apparatus according to claim 13, wherein the length of said first layer is measured in a direction perpendicular to a direction of feeding the transfer material and along a transfer material carrying surface of said transfer material carrying member.

15. An image forming apparatus according to claim 13, wherein said first layer is contactable to the image bearing member or to the transfer material, and said second layer is disposed across said first layer from the image bearing member or the transfer material.

16. An image forming apparatus according to claim 13, wherein said first layer and said second layer are made of thermoplastic resin material.

17. An image forming apparatus according to claim 16, wherein said thermoplastic resin material is polyimide resin material.

18. An image forming apparatus according to claim 15, wherein said first layer includes resistance adjusting material.

19. An image forming apparatus according to claim 18, wherein said resistance adjusting material is carbon black.

20. An image forming apparatus according to claim 18, wherein said first layer has a surface resistance of $10^{13}$–$10^{14}$ Ohm/□.

21. An image forming apparatus according to claim 13, wherein said first layer and said second layer are integrally formed.

22. An image forming apparatus according to claim 13, wherein Ha+Hb is 25–2000 microns.

23. An image forming apparatus according to claim 13, wherein the ambient condition is at least one of an ambient temperature and an ambient humidity.

24. An image forming apparatus according to claim 23, wherein the change in the ambient condition is between 15° C. and 10% RH and 30° C. and 80% RH.

* * * * *

UNITED STATES PATENT AND TRADEMARK OFFICE

CERTIFICATE OF CORRECTION

PATENT NO. : 6,615,016 B2
DATED : September 2, 2003
INVENTOR(S) : Yoichi Kimura

It is certified that error appears in the above-identified patent and that said Letters Patent is hereby corrected as shown below:

Column 8,
Line 57, "photoconductive layer" should read -- photoconductive layer 1B --.

Column 9,
Line 19, "has" should read -- have --; and
Line 65, "The" should read -- As the --.

Column 10,
Line 25, "layer C" should read -- layer 2C --.

Column 13,
Line 65, "form" should read -- from --.

Column 14,
Line 16, "In" should read -- in --.

Column 15,
Line 66, "tot he" should read -- to the --.

Figure 12:
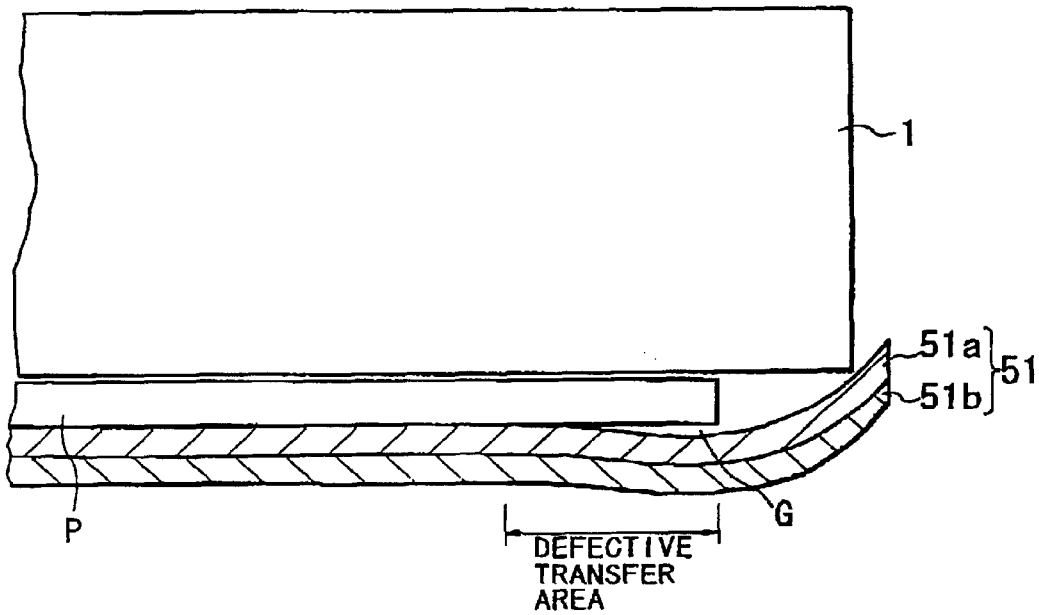
FIG. 12 is an enlarged widthwise sectional view of one of the two widthwise edges of the transfer belt, which has warped.

Column 16,
Line 4, "the recording" should read -- the transfer belt 51 warped as shown in FIG. 12, the --.

Column 18,
Line 39, "disposed" should read -- composed --.

Column 21,
Line 3, "above described" should read -- above-described --; and
Line 5, "transfer belt 1" should read -- transfer belt 51, --.

UNITED STATES PATENT AND TRADEMARK OFFICE

CERTIFICATE OF CORRECTION

PATENT NO. : 6,615,016 B2
DATED : September 2, 2003
INVENTOR(S) : Yoichi Kimura

It is certified that error appears in the above-identified patent and that said Letters Patent is hereby corrected as shown below:

Column 22,
Line 46, "material transfer" should read -- material; ¶transfer --; and
Line 49, "transfer" should read -- transfer material --.

Signed and Sealed this

Tenth Day of February, 2004

JON W. DUDAS
*Acting Director of the United States Patent and Trademark Office*